United States Patent [19]

Taniguchi et al.

[11] Patent Number: 4,778,294

[45] Date of Patent: Oct. 18, 1988

[54] PRINTER

[75] Inventors: Jun Taniguchi, Tamayama; Fumihisa Hori, Takizawa, both of Japan

[73] Assignee: Alps Electric Co., Ltd., Tokyo, Japan

[21] Appl. No.: 84,908

[22] Filed: Aug. 13, 1987

[30] Foreign Application Priority Data

Oct. 9, 1986 [JP] Japan ..... 61-154451[U]

[51] Int. Cl.[4] ..... B41J 1/20

[52] U.S. Cl. ..... 400/185; 400/146; 101/93.14

[58] Field of Search ..... 400/145.1, 145.2, 146, 400/185, 187, 636, 144.2, 144.3; 101/93.13, 93.14, 105, 111

[56] References Cited

U.S. PATENT DOCUMENTS

| | | | |
|---|---|---|---|
| 4,449,835 | 5/1984 | Arai | 400/185 X |
| 4,560,294 | 12/1985 | Sugawara et al. | 101/93.14 X |
| 4,580,917 | 4/1986 | Hibino | 400/636 |
| 4,632,581 | 12/1986 | Ito et al. | 400/145.2 X |

FOREIGN PATENT DOCUMENTS

| | | | |
|---|---|---|---|
| 105571 | 8/1980 | Japan | 400/146 |
| 199179 | 11/1983 | Japan | 400/146 |

*Primary Examiner*—Charles Pearson

*Attorney, Agent, or Firm*—Guy W. Shoup; Leighton K. Chong; Paul J. Winters

[57] ABSTRACT

A printer comprising a printing drive gear for generating a print operation output and having a print control cam for controlling a print operation; a paper feed control cam adapted to be rotated with the printing drive gear as a unit for controlling a paper feed operation; a paper feed driving intermittent gear for generating a paper feeding output; a ratchet wheel for controlling an output timing of the paper feed driving intermittent gear; a print control lever adapted to be moved in association with the print control cam and be releasably engaged therewith; a paper feed control lever adapted to be moved in association with the paper feed control cam; a pawl lever adapted to be moved integrally with the paper feed control lever and be releasably engaged with the ratchet wheel; and an electromagnetic clutch capable of generating a first rotative output for driving the print control lever and a second rotative output for driving the paper feed control lever and the pawl lever, wherein the paper feed control cam has such a shape as to disengage the pawl lever from the ratchet wheel after printing of a type at a final column.

7 Claims, 3 Drawing Sheets

PRINTER

BACKGROUND OF THE INVENTION

The present invention relates to a type belt printer for use with an electronic desk calculator or the like, and more particularly to a printer which may eliminate an undue time in a printing operation to increase a printing speed.

FIG. 4 is a plan view of a conventional type belt printer. Referring to FIG. 4, a motor 2 is supported to a frame 1, and a pinion 4 is mounted on an output shaft 3 of the motor 2. Rotation of the pinion 4 is transmitted through a pair of idle gears 5 and 6 to a driving pulley 7. A type selector lever 8 is rotatably provided in the vicinity of the driving pulley 7. A pawl portion 9 of the type selector lever 8 is adapted to be engaged with the driving pulley 7 to stop rotation of the driving pulley 7. Further, an electromagnetic clutch 10 is provided in the vicinity of the type selector lever 8. When the electromagnetic clutch 10 is energized, the type selector lever 8 is rotated to engage the pawl portion 9 with the driving pulley 7.

The driving pulley 7 is exposed to one side of the frame 1, and a driven pulley 11 is exposed to the other side of the frame 1. As shown in FIGS. 5 and 6, a type belt 12 having a plurality of types 13 arranged in series is wound around the driving pulley 7 and the driven pulley 11.

A platen 14 supported to the frame 1 is provided in front of the type belt 12. A carriage 15 having a hammer 16 for hammering onto the platen 14 a desired type 13 of the type belt 12 on the platen 14 side is provided inside the type belt 12 in such a manner as to be laterally movable by a suitable mechanism (not shown). The carriage 15 is formed at its lower end with a pair of mask members 17 for preventing any two types adjacent to a desired type 13 of the type belt 12 from being printed when the desired type 13 is hammered by the hammer 16. The mask members 17 are formed by bending a support portion 17a horizontally integrally projecting from the carriage 15, and are supported like a cantilever by the support portion 17a. The mask members 17 are spaced from each other a distance substantially equal to a width of one type 13, and are located between the type belt 12 and the platen 14.

The carriage 15 is normally biased by a spring 18 so as to be returned to a home position under a free condition. A print paper S is supplied between the type belt 12 and the carriage 15 by a pinch roller 19 and a paper feed roller (not shown). An ink roll 20 for coating ink to the type belt 12 is provided in the vicinity of the driven pulley 11.

In operation, the rotation of the motor 2 is transmitted from the pinion 4 through the idle gears 5 and 6 to the driving pulley 7 to thereby rotate the driving pulley 7, which is followed by the rotation of the driven pulley 11 and the type belt 12. When the electromagnetic clutch 10 is energized, the type selector lever 8 is rotated to engage the pawl portion 9 with the driving pulley 7, thereby stopping the rotation of the driving pulley 7 and locating a desired type 13 at a position opposed to the carriage 15. Then, the hammer 16 in the carriage 15 is driven to press the type 13 onto the print paper S exposed in front of the platen 14, thereby transferring the ink coated on the type 13 to the print paper S. Thus, the printing operation at a first column is ended. Next, the electromagnetic clutch 10 is deenergized to shift up the carriage 15. Then, the above-mentioned printing operation is repeated for desired columns to complete the printing operation of one line. Thereafter, the carriage 15 is returned to the home position. Then, the driving pulley 7 is idled by a predetermined rotative amount without conducting selection of the type, and the print paper S is automatically fed by an amount of one line by the pinch roller 19 and the paper feed roller (not shown), whereby the printing operation of the next one line is ready to start.

In the conventional printer as mentioned above, the feeding of the print paper S is started upon completion of idling of the driving pulley 7 by the predetermined rotative amount after the end of the printing operation of one line. That is, since the conventional printer is designed to mechanically shift the printing operation to the paper feeding operation, the paper feeding operation is carried out after completion of idling of the driving pulley 7 by the predetermined rotative amount under the condition where the printing operation is not carried out. During printing operation of one line, while the driving pulley 7 is rotated once after the end of printing of a certain column, a type at the next column is selected to thereby reset the number of revolution of the driving pulley 7.

However, a time for idling the driving pulley 7 by the predetermined rotative amount is wasteful in view of a requisite printing time of the printer. In the case of printing plural lines, such an idling time causes elongation of the requisite printing time.

SUMMARY OF THE INVENTION

It is an object of the present invention to provide a printer which may shorten a time from the end of printing of a final column in one line to the start of feeding of a print paper, and thereby increase a printing speed.

According to the present invention, there is provided a printer comprising a printing drive gear for generating a print operation output and having a print control cam for controlling a print operation; a paper feed control cam adapted to be rotated with the printing drive gear as a unit for controlling a paper feed operation; a paper feed driving intermittent gear for generating a paper feeding output; a ratchet wheel for controlling an output timing of the paper feed driving intermittent gear; a print control lever adapted to be moved in association with the print control cam and be releaseably engaged therewith; a paper feed control lever adapted to be moved in association with the paper feed control cam; a pawl lever adapted to be moved integrally with the paper feed control lever and be releaseably engaged with the ratchet wheel; and an electromagnetic clutch capable of generating first and second rotative outputs, wherein the first rotative output drives the print control lever, while the second rotative output drives the paper feed control lever and the pawl lever, and wherein the paper feed control cam has such a shape as to disengage the pawl lever from the ratchet wheel after printing of a type at a final column.

In operation, when the electromagnetic clutch is energized, the print control lever is driven to be disengaged from a cam recess of the print control cam, and accordingly the printing drive gear and the paper feed control cam start rotating to thereby start printing a type at a column opposed to a hammer. Thereafter, when the electromagnetic clutch is deenergized, the print control lever is rotated by a predetermined distance in association with the print control cam, and is then engaged again with the cam recess of the print control cam to stop the rotation of the printing drive gear and the paper feed control cam. The printing operation at each column is carried out during half a rotation of the printing drive gear.

In the case that the printing operation at each column in one line is continuously carried out, the paper feed control lever and the pawl lever are maintained in a fixed condition. That is, even when the electromagnetic clutch is energized during such a continuous printing operation, these levers are not driven because the paper feed control lever is hindered from rotating by the paper feed control cam. Accordingly, the pawl lever remains in engagement with the ratchet wheel, so that the paper feeding operation is not carried out.

After the printing operation at the final column in one line is ended, the pawl lever and the other components are driven by the electromagnetic clutch. That is, the paper feed control cam is rotated with the printing drive gear even after the printing operation, and when the recess of the paper feed control cam comes to a position opposed to the paper feed control lever, the electromagnetic clutch is energized, and the paper feed control lever is rotated in association with the recess. Simultaneously, the pawl lever is brought into disengagement from the ratchet wheel, thereby permitting rotation of the ratchet wheel and the paper feed driving intermittent gear. Thus, the paper feeding operation is carried out.

Other objects and features of the invention will be more fully understood from the following detailed description and appended claims when taken with the accompanying drawings.

DETAILED DESCRIPTION OF THE PREFERRED EMBODIMENT

Figure 1:
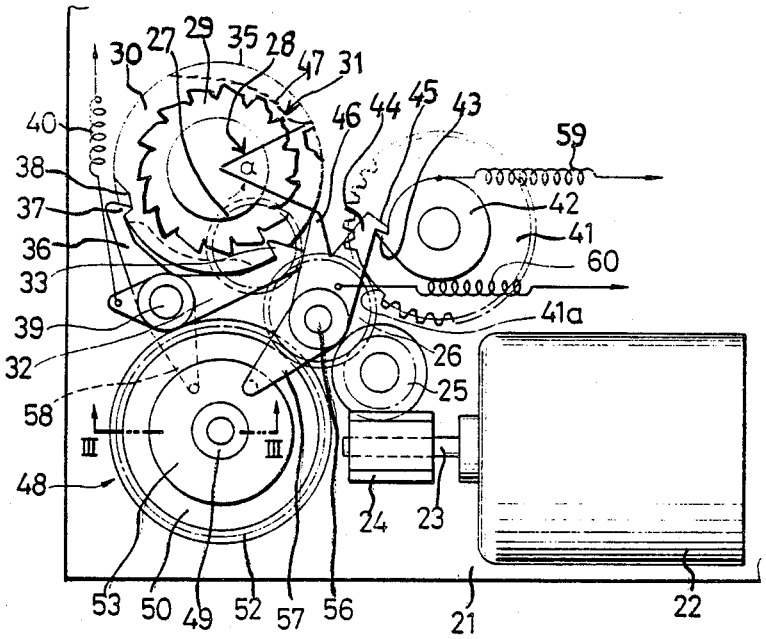
FIG. 1 is a plan view of a preferred embodiment according to the present invention.
Figure 2:
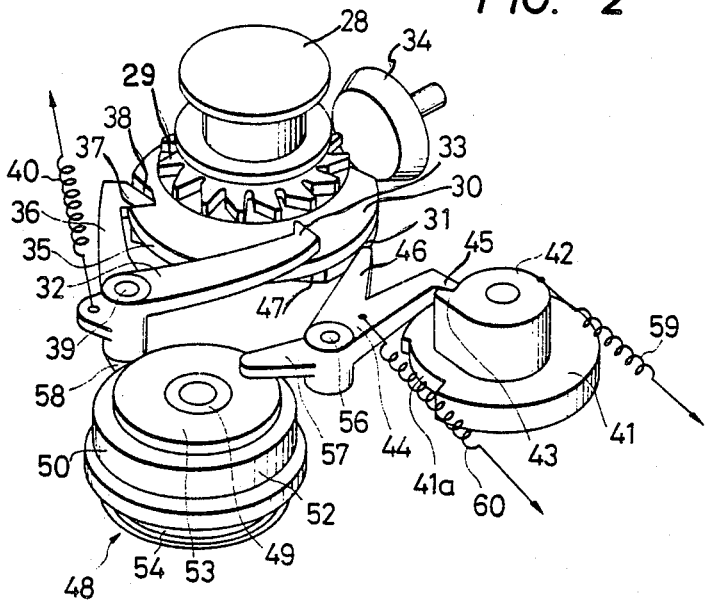
FIG. 2 is a perspective view of the essential part of the preferred embodiment.
Figure 3:
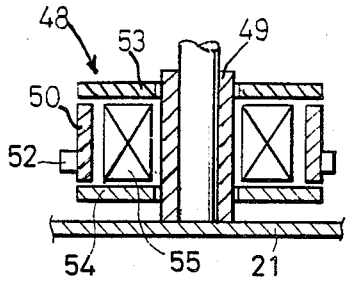
FIG. 3 is a cross-sectional view taken along the line III—III in FIG. 1.
Figure 4:
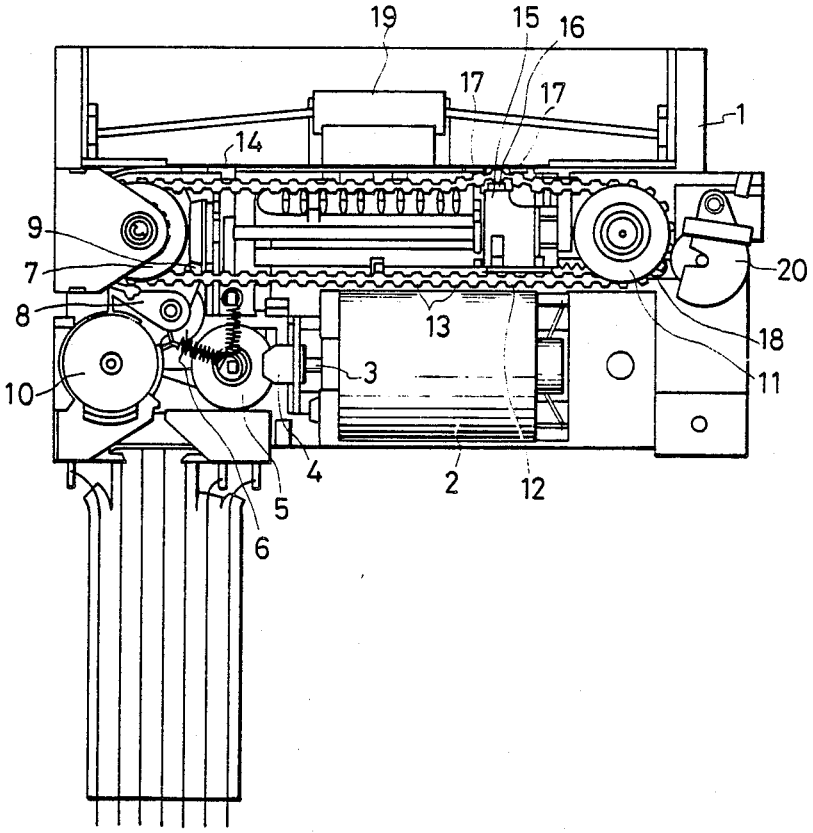
PRIOR ART FIG. 4
FIG. 4 is a plan view of the conventional printer.
Figure 5:
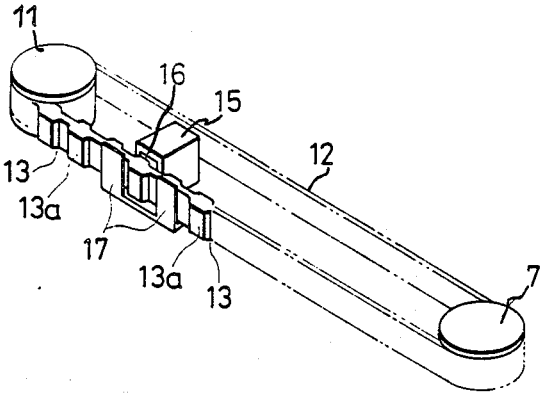
PRIOR ART FIG. 5
FIG. 5 is an enlarged perspective view of a part of the printer shown in FIG. 4.
Figure 6:
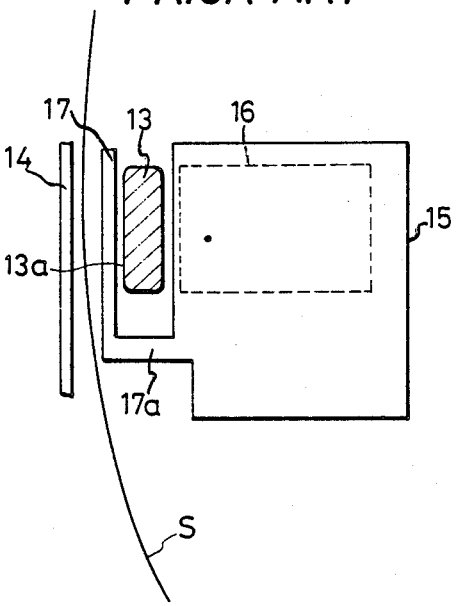
FIG. 6 PRIOR ART
FIG. 6 is a side view of a part of the printer shown in FIG. 4.

Referring to FIGS. 1 to 3 which show a preferred embodiment of the present invention, reference numeral 21 designates a frame, on which a motor 22 is fixed. The motor 21 has an output shaft 23 to which a worm 24 is fixed. The worm 24 is meshed with a worm gear 25 which is meshed with an idle gear 26, which is in turn meshed with a final idle gear 27. The final idle gear 27 is connected through planetary gears (not shown) to a belt driving pulley 28, a selector ratchet 29, a printing drive gear 30 and a paper feed control cam 31. The belt driving pulley 28 and the selector ratchet 29 are connected with each other so as to be rotated as a unit. The belt driving pulley 28 drives a type belt (not shown) wound therearound, and the selector ratchet 29 stops rotating when it is engaged with a selector pawl 33 of a selector lever 32 to select a type of the type belt. The printing drive gear 30 and the paper feed control cam 31 are connected with each other so as to be rotated as a unit. The printing drive gear 30 is a bevel gear which is meshed with a bevel gear 34 to rotate the same, thereby driving a hammer (not shown) for printing. The printing drive gear 30 is formed at its outer circumference with a print control cam 35 for controlling a printing operation. The print control cam 35 is moved in association with an engagement pawl 37 of a print control lever 36 moving with the selector lever 32 as a unit. As shown in FIG. 1, the print control cam 35 is formed with a pair of cam recesses 38 arranged in diametrically opposed relationship to each other. The cam recesses 38 are adapted to be engaged with the engagement pawl 37 of the print control lever 36 to thereby stop the rotation of the printing drive gear 30. The paper feed control cam 31 is formed in such a shape as to control a paper feed operation. When either of the assembly of the belt driving pulley 28 and the selector ratchet 29 or the assembly of the printing drive gear 30 and the paper feed control cam 31 is rotated, the other assembly is stopped by the planetary gears. Further, a direction of rotation of one assembly is counter to that of the other assembly. That is, the assembly of the belt driving pulley 28 and the selector ratchet 29 is rotated counterclockwise as viewed in FIG. 1, while the assembly of the printing drive gear 30 and the paper feed control cam 31 is rotated clockwise as viewed in FIG. 1. To maintain such a rotational relation, the selector lever 32 and the print control lever 36 are pivotably mounted on a pivotal shaft 39 in such a manner that when either of the engagement between the selector pawl 33 and the selector ratchet 29 or the engagement between the engagement pawl 37 and the cam recess 38 is effected, the other engagement is released. The selector lever 32 and the print control lever 36 are biased by a tension spring 40 so that the print control lever 36 may be normally engaged with the print control cam 35. The idle gear 26 meshed with the worm gear 25 is meshably connected to a paper feed driving intermittent gear 41 for applying a paper feed output to a paper feed roller (not shown). The paper feed driving intermittent gear 41 is connected to a ratchet wheel 42 in such a manner as to be rotated as a unit. The ratchet wheel 42 is formed with an engagement pawl 43 to be engaged with a pawl portion 45 of a pawl lever 44. When the engagement pawl 43 is engaged with the pawl portion 45, a cut-away portion 41a of the paper feed driving intermittent gear 41 is positioned in opposition to the idle gear 26 to thereby control a rotational timing of the paper feed driving intermittent gear 41, that is, an output timing of a paper feed output. The paper feed driving intermittent gear 41 and the ratchet wheel 42 are normally biased by a tension spring 59 to obtain a torque in such a direction where when the engagement pawl 43 of the ratchet wheel 42 is disengaged from the pawl portion 45 of the pawl lever 44, a toothed portion of the paper feed driving intermittent gear 41 is brought into mesh with the idle gear 26. The pawl lever 44 is integrally formed with a paper feed control lever 46 adapted to move in association with the paper feed control cam 31. Both the levers 44 and 46 are pivotably mounted on a pivotal shaft 56, and are normally biased by a tension spring 60 to obtain a torque for engaging the pawl portion 45 of the pawl lever 44 with the engagement pawl 43 of the ratchet wheel 42. The paper feed control cam 31 is formed with a pair of recesses 47 at intermediate portions between the cam recesses 38, so that when the paper feed control lever 46 and the pawl lever 44 are integrally moved, the pawl portion 45 of the pawl lever 44 may be disengaged from the engagement pawl 43 of the ratchet wheel 42. A start position of the recesses 47 is set at a position offset by a central angle $\alpha$ in a rotational direction of the paper feed control cam 31 as measured from a position where the paper feed control lever 46 is engaged with the paper feed control cam 31 which is stopped by engaging the engagement pawl 37 of the print control lever 36 with the cam recess 38 of the print control cam 35. The central angle $\alpha$ is set in such a manner that when the engagement pawl 37 of the print control lever 36 is disengaged from the cam recess 38 of the print control cam 35 to start printing, and a little time has been elapsed after ending of a predetermined printing operation, the recess 47 of the paper feed control cam 31 is opposed to the paper feed control lever 46. Accordingly, the paper feeding operation is carried out during the little time elapsed after the end of printing of a final column in one line.

An electromagnetic clutch 48 is provided in the vicinity of the idle gear 26. The electromagnetic clutch 48 includes a large-diameter annular rotating member 50 rotatably supported to a central fixed shaft 49, and also includes a gear 52 fixed on the outer circumference of the rotating member 50, which gear 52 is meshed with the idle gear 26. An annular upper driving plate 53 is rotatably and axially movably mounted on the fixed shaft 49 on the upper side of the rotating member 50, and similarly, an annular lower driving plate 54 is rotatably and axially movably mounted on the fixed shaft 49 on the lower side of the rotating member 50. A solenoid coil 55 is accommodated in the rotating member 50.

When the solenoid coil 55 of the electromagnetic clutch 48 is supplied with current, the upper driving plate 53 and the lower driving plate 54 are attracted to the rotating member 50 by a magnetic force of the solenoid coil 55, and are rotated together with the rotating member 50, thereby generating two kinds of rotational outputs. The upper driving plate 53 is connected to an interlocking lever 57 integrally extending from the pawl lever 44 and the paper feed control lever 46, while the lower driving plate 54 is connected to an interlocking lever 58 integrally extending from the selector lever 32 and the print control lever 36. With this arrangement, when the electromagnetic clutch 48 is energized, the interlocking lever 57 is rotated counterclockwise as viewed in FIG. 1 about the pivotal shaft 56, while the other interlocking lever 58 is rotated counterclockwise about the pivotal shaft 39. Thus, two kinds of driving systems may be independently driven.

There will be now described the operation of the preferred embodiment, wherein as a printing step is similarly carried out every column, the following description will be directed to a series of operation from the printing step at a final column in one line.

Each component shown in FIGS. 1 and 2 is in a home position, and the motor 22 is in rotation. Accordingly, the belt driving pulley 28 and the selector ratchet 29 receive the torque of the motor 22 to rotate as a unit. The rotating member 50 of the electromagnetic clutch 48 is also rotated by the torque of the motor 22. The engagement pawl 37 of the print control lever 36 is engaged with the cam recess 38, and the pawl portion 45 of the pawl lever 44 is also engaged with the engagement pawl 43 of the ratchet wheel 38. As a result, the printing drive gear 30, the paper feed control cam 31 and the paper feed driving intermittent gear 41 are stopped. When a type of the type belt at the final column to be printed reaches the final column by the rotation of the belt driving pulley 28, the solenoid coil 55 of the electromagnetic clutch 48 is supplied with current, and the upper and lower driving plates 53 and 54 are attracted to the upper and lower ends of the rotating member 50 under rotation, thereby starting rotating. At this time, the interlocking lever 58 only is rotated against the resilient force of the tension spring 40, and the selector pawl 33 of the selector lever 32 is engaged with the selector ratchet 29 to stop the selector ratchet 29 and the belt driving pulley 28, thereby positioning a desired type at the final column. Simultaneously, the engagement pawl 37 of the print control lever 36 is disengaged from the cam recess 38 of the print control cam 35 to start rotating the printing drive cam 30 and the paper feed control cam 31. The rotation of the printing drive cam 30 and the paper feed control cam 31 continues until the engagement pawl 37 of the print control lever 36 is brought into engagement with the subsequent cam recess 38. Then, the bevel gear 34 is rotated in concert with the rotation of the printing drive gear 30 to drive the hammer and thereby carry out printing at the final column.

As the paper feed control lever 46 integrally connected with the interlocking lever 57 is engaged with the outermost circumference of the paper feed control cam 31 upon excitation of the solenoid coil 55, the interlocking lever 57, the paper feed control lever 46 and the pawl lever 44 are hindered from rotating, and accordingly the paper feed driving intermittent gear 41 is maintained under a stopped condition.

When the rotation of the printing drive gear 30 and the paper feed control cam 31 proceeds to terminate the printing at the final column by the hammer, and after a little elapsed time, the printing drive gear 30 and the paper feed control cam 31 are rotated by the central angle $\alpha$ from the print start position, the print control lever 36 is brought into a position opposed to the leading edge of the recess 47 of the paper feed control cam 31. At this time, the solenoid coil 55 of the electromagnetic clutch 48 is supplied with current to rotate the rotating member 50 again. Then, as the paper feed control lever 46 is in a rotatable condition at this time, the interlocking lever 57, the pawl lever 44 and the paper feed control lever 46 are rotated together against the resilient force of the tension spring 60 to disengage the pawl portion 45 of the pawl lever 44 from the engagement pawl 43 of the ratchet wheel 42. As a result, the paper feed driving intermittent gear 41 is slightly rotated clockwise by the torque due to the resilient force of the tension spring 59, and the toothed portion of the gear 41 is brought into mesh with the idle gear 26. Accordingly, the gear 41 is forcibly rotated by the idle gear 26 to transmit a torque to the paper feed roller and thereby start the paper feeding operation.

Upon the second excitation of the solenoid coil 55, the interlocking lever 58, the selector lever 32 and the print control lever 36 are hindered from rotating because the engagement pawl 37 of the print control lever 36 is engaged with the outermost circumference of the print control cam 35.

Until one rotation of the paper feed driving intermittent gear 41 is terminated, the paper feed control lever 46 is disengaged from the recess 47 of the paper feed control cam 31, and is engaged again with the outermost circumference of the paper feed control cam 31. Accordingly, the pawl portion 45 of the pawl lever 44 is returned to the home position at this time. Thus, the pawl portion 45 of the pawl lever 44 is engaged again with the engagement pawl 43 of the ratchet wheel 42 upon one rotation of the paper feed driving intermittent gear 41, and then the gear 41 is stopped to feed the paper by an amount of one line.

Thereafter, the printing drive gear 30 and the paper feed control cam 31 proceed to rotate, and accordingly the engagement pawl 37 of the print control lever 36 is engaged with the subsequent cam recess 38 in receipt of the resilient force of the tension spring 40. At this time, the rotation of the printing drive gear 30 and the paper feed control cam 31 is stopped. Simultaneously, the selector pawl 33 of the selector lever 32 is disengaged from the selector ratchet 29, and the selector ratchet 29 and the belt driving pulley 28 are rotated again to thereby start selecting a type at a first column in the next line.

During printing of any types at columns on the way of one line, the solenoid coil 55 of the electromagnetic clutch 48 is not excited even when the paper feed control lever 46 comes into opposition to the recess 47 of the paper feed control cam 31. Accordingly, the interlocking lever 57, the paper feed control lever 46 and the pawl lever 44 remain in the home position, and therefore the paper feed operation is not carried out.

As is described above, after a type at the final column in one line is printed, and then after a short time is elapsed, the paper feed operation is started. Accordingly, it is possible to greatly shorten a requisite time from the start of printing of one line to the end of paper feeding as compared with the prior art where the paper feeding operation is started after a time for idling the belt driving pulley by a predetermined rotative amount is elapsed. Especially in the case of printing plural lines, a requisite printing time may be greatly shortened. In other words, a printing speed of the printer may be increased.

Furthermore, excitation of the electromagnetic clutch 48 for driving the levers 32, 36, 44 and 46 is effected by supplying a triggering pulse current of short time for merely releasing the engagement between the engagement pawl 37 and the cam recess 38 and the engagement between the engagement pawl 43 and the pawl portion 45. Accordingly, power consumption may be reduced as compared with the prior art where excitation of the electromagnetic clutch 10 is continued from the start of printing to the end of printing so as to maintain the engagement between the pawl portion 9 of the selector lever 8 and the driving pulley 7.

While the invention has been described with reference to a specific embodiment, the description is illustrative and is not to be construed as limiting the scope of the invention. Various modifications and changes may occur to those skilled in the art without departing from the spirit and scope of the invention as defined by the appended claims.

What is claimed is:

1. A printer comprising a printing drive gear for generating a print operation output and having a print control cam for controlling a print operation; a paper feed control cam adapted to be rotated with said printing drive gear as a unit for controlling a paper feed operation; a paper feed driving intermittent gear for generating a paper feeding output; a ratchet wheel for controlling an output timing of said paper feed driving intermittent gear; a print control lever adapted to be moved in association with said print control cam and be releaseably engaged therewith; a paper feed control lever adapted to be moved in association with said paper feed control cam; a pawl lever adapted to be moved integrally with said paper feed control lever and be releaseably engaged with said ratchet wheel; and an electromagnetic clutch capable of generating first and second rotative outputs, said first rotative output driving said print control lever, while said second rotative output drives said paper feed control lever and said pawl lever, wherein said paper feed control cam has such a shape as to disengage said pawl lever from said ratchet wheel after printing of a type at a final column.

2. The printer as defined in claim 1, further comprising a first tension spring for biasing said print control lever to normally engage said print control lever with said print control cam.

3. The printer as defined in claim 2, further comprising a second tension spring for biasing said paper feed driving intermittent gear and said ratchet wheel to mesh a toothed portion of said intermittent gear with an idle gear when said pawl lever is disengaged from said ratchet wheel.

4. The printer as defined in claim 3, further comprising a third tension spring for biasing said pawl lever to normally engage said pawl lever with said ratchet wheel.

5. The printer as defined in claim 1, wherein said paper feed control cam is formed with a recess, and said paper feed control lever is brought into opposition to said recess when a short time is elapsed after ending of a predetermined print operation.

6. The printer as defined in claim 1, wherein said electromagnetic clutch comprises a central fixed shaft; an annular rotating member rotatably mounted on said central fixed shaft; a gear fixed on the outer circumference of said rotating member and meshed with said idle gear; an annular upper driving plate rotatably and axially movably mounted on said central fixed shaft above said rotating member; an annular lower driving plate rotatably and axially movably mounted on said central fixed shaft below said rotating member; and a solenoid coil accommodated in said rotating member.

7. The printer as defined in claim 6, further comprising a first interlocking lever integrally extending from said pawl lever and said paper feed control lever and connected to said upper driving plate; and a second interlocking lever integrally extending from said print control lever and connected to said lower driving plate.

* * * * *